US006179215B1

(12) United States Patent
Shea

(10) Patent No.: US 6,179,215 B1
(45) Date of Patent: Jan. 30, 2001

(54) COMPOSITE RAILROAD CROSSTIE

(75) Inventor: Marc Shea, Cromwell, IN (US)

(73) Assignee: Primix International, LLC, Atwood, IN (US)

( * ) Notice: Under 35 U.S.C. 154(b), the term of this patent shall be extended for 0 days.

(21) Appl. No.: 09/190,524

(22) Filed: Nov. 12, 1998

Related U.S. Application Data

(63) Continuation-in-part of application No. 08/902,483, filed on Jul. 29, 1997.
(60) Provisional application No. 60/022,076, filed on Jul. 29, 1996.

(51) Int. Cl.[7] ..... E01B 21/04
(52) U.S. Cl. ..... 238/29
(58) Field of Search ..... 238/29, 30, 45, 238/83, 84, 85

(56) References Cited

U.S. PATENT DOCUMENTS

| | | | |
|---|---|---|---|
| 3,951,384 | 4/1976 | Hildreth, Jr. | 256/1 X |
| 3,957,250 | 5/1976 | Murphy | 256/51 X |
| 4,083,491 | 4/1978 | Hill | 238/98 |
| 5,030,662 | 7/1991 | Banerjie | 521/43.5 |
| 5,053,274 | 10/1991 | Jonas | 428/332 |
| 5,238,734 | 8/1993 | Murray | 428/292 |
| 5,271,203 | 12/1993 | Nagle | 52/294 X |
| 5,320,794 | 6/1994 | Holmes | 264/211.21 |
| 5,609,295 * | 3/1997 | Richards | 238/84 |
| 5,675,956 | 10/1997 | Nevin | 52/726.1 |

* cited by examiner

*Primary Examiner*—Russell D. Stormer
*Assistant Examiner*—Robert J. McCarry, Jr.
(74) *Attorney, Agent, or Firm*—Baker & Daniels

(57) ABSTRACT

A railroad crosstie includes an outer casing made of a 50—50 mixture by volume of recycled high density polyethylene and crumb rubber from recycled tires. The outer casing includes an upper section and a lower section, which cooperate to define a cavity in which a beam or beams are installed. Each of the beams include an aperture below the rail supporting areas of the crosstie and an insert of the same composite material of which the outer casing is made is installed within the beams below the rail support areas. A flowable concrete mixture fills the cavity defined within the outer casing including the cavities defined within the beams.

35 Claims, 6 Drawing Sheets

COMPOSITE RAILROAD CROSSTIE

This application is a continuation in part of U.S. patent application Ser. No. 08/902,483, filed Jul. 29, 1997, which claims domestic priority based on U.S. Provisional Patent Application Ser. No. 60/022,076, filed Jul. 29, 1996.

BACKGROUND OF THE INVENTION

Railroad crossties have been made almost exclusively of wood from the beginning of the railroad age. The wooden crossties are held in place by ballast rock, and the rails are attached using tie plates and cut spikes. This is a readily available and commonly used system. The wooden ties accept and hold spikes, so that the rail and tie plate fastening systems may be secured to the ties. A wood tie will flex under load. The resulting flexing is beneficial only in that it helps to provide for a softer ride. However, the flexing also increases the displacement of, or "pumpinpg" of, the supporting ballast out and away from the tie. This increases maintenance cost. The flexing also "pumps" or works the spikes up and loosens them, resulting in additional maintenance cost. Wooden ties deteriorate and must be replaced at regular intervals, resulting in high maintenance costs.

Railroad ties made of material other than wood have been proposed. For example, U.S. Pat. No. 5,238,734 to Murray discloses a railroad tie made from a mixture of recycled tire fragments and an epoxy mixture. Other patents disclosing railroad ties made out of composite materials include U.S. Pat. No. 4,150,790 (Potter) and U.S. Pat. No. 4,083,491 (Hill). Although ties made out of composite materials provide significantly longer life than conventional wooden ties, it has not been possible to provide composite ties that are durable enough to withstand the heavy repeated loads of main line railroad tracks. Both wooden and composite railroad ties tend to pump ballast rock away from the rails, thus requiring frequent reballasting.

Concrete crossties that are reinforced with various materials are also known in the prior art, such as the crosstie disclosed in U.S. Pat. No. 1,566,550 (McWilliam). However, conventional concrete crossties are too hard and brittle to use conventional and standard fastening systems (tie plates and cut spikes). Concrete ties use pre-casted fasteners that are attached during the curing stage in the tie manufacturing process. Furthermore, each tie must be individually loaded and obstructed from the mold. The concrete crossties are stiff and non-flexible, this is advantageous and provides a stiffer track module, improved lateral stability and gauge control, increased rail life, and greater locomotive fuel economy. What should have been a significantly lower maintenance cost due to the lack of "pumping" of the ballast rock, has actually become another maintenance cost. The concrete tie is so hard that it pulverizes the ballast rock beneath it which results in a sand like or soft support system.

SUMMARY OF THE INVENTION

The railroad crosstie according to the present invention combines the best features of the wooden and concrete crossties. The present invention offers all the benefits of the concrete tie while adding "shock absorbing" and "impact resistance" features with the outer composite shell. This helps to eliminate the pulverizing of the ballast rock. The ballast rock actually imbeds itself into the composite helping to keep it in place.

Accordingly, an outer casing is provided which is made out of, preferably, a 50/50 mixture of high density polyethylene (such as from recycled household containers) in which reinforcing beams have been mounted in the cavity within the casing. The new system also uses traditional fastening systems. Inserts are placed within the beams that are made out of the same composite material from which the casing is made, and the upper surfaces of the beams define apertures so that spikes can be driven through the casings, the apertures, and into the inserts. The rubber and plastic mixture is sufficiently yieldable so that spikes can be driven through the casing and into the inserts in much the same way as spikes can be driven in conventional wooden crossties. The rubber gives the composite a "gripping feature" that has been proven to hold the spike better than wood, resulting in higher spike pull testing. The cavity is then filled with concrete, including the portions of the cavity within the beams and between the inserts. The beams, which are preferably made of steel, stiffen the cross tie and prevent pulverizing of the concrete. If heavier axle loads are to be accommodated, tubular beams made out of a heavier gauge of steel may be used, which stiffens the beam, resulting in a higher positive bending moment. The higher the bending moment the better the track modules.

Accordingly, crossties made according to the present invention have a bending moment that can be manipulated to best fit the end user's needs while having a cross section of the standard 7"×9" size that any concrete tie which meets the railroads requirements must be 8"×10" in cross section. Any tie other than a 7"×9", can not be used as a replacement tie for the 14,000,000 ties that are replaced each year. The ability to adjust the bending moment and remain within the 7"×9" cross section is unique to this invention.

Accordingly, a railroad crosstie is provided that combines the benefits of conventional wooden ties and concrete ties. The cross tie has the durability and load carrying capacity of a concrete tie, but the composite material has shock absorbing and vibration dampening qualities such that the ride of trains on the tracks supported by the tie is smooth. Ballast rock embeds in the casing material, just as in wooden ties, so that the ballast is not pulverized or displaced. Since the stiffness of the cross tie may be controlled, the cross tie may be optimized to provide a smooth ride, but yielding and movement of the tie can be limited so that the tie will not pump ballast rock away from the rails as is the case with wooden ties.

BRIEF DESCRIPTION OF THE INVENTION

These and other advantages of the present invention will become apparent from the following description, with reference to the accompanying drawings, in which.

DETAILED DESCRIPTION OF THE PREFERRED EMBODIMENTS

Figure 1:
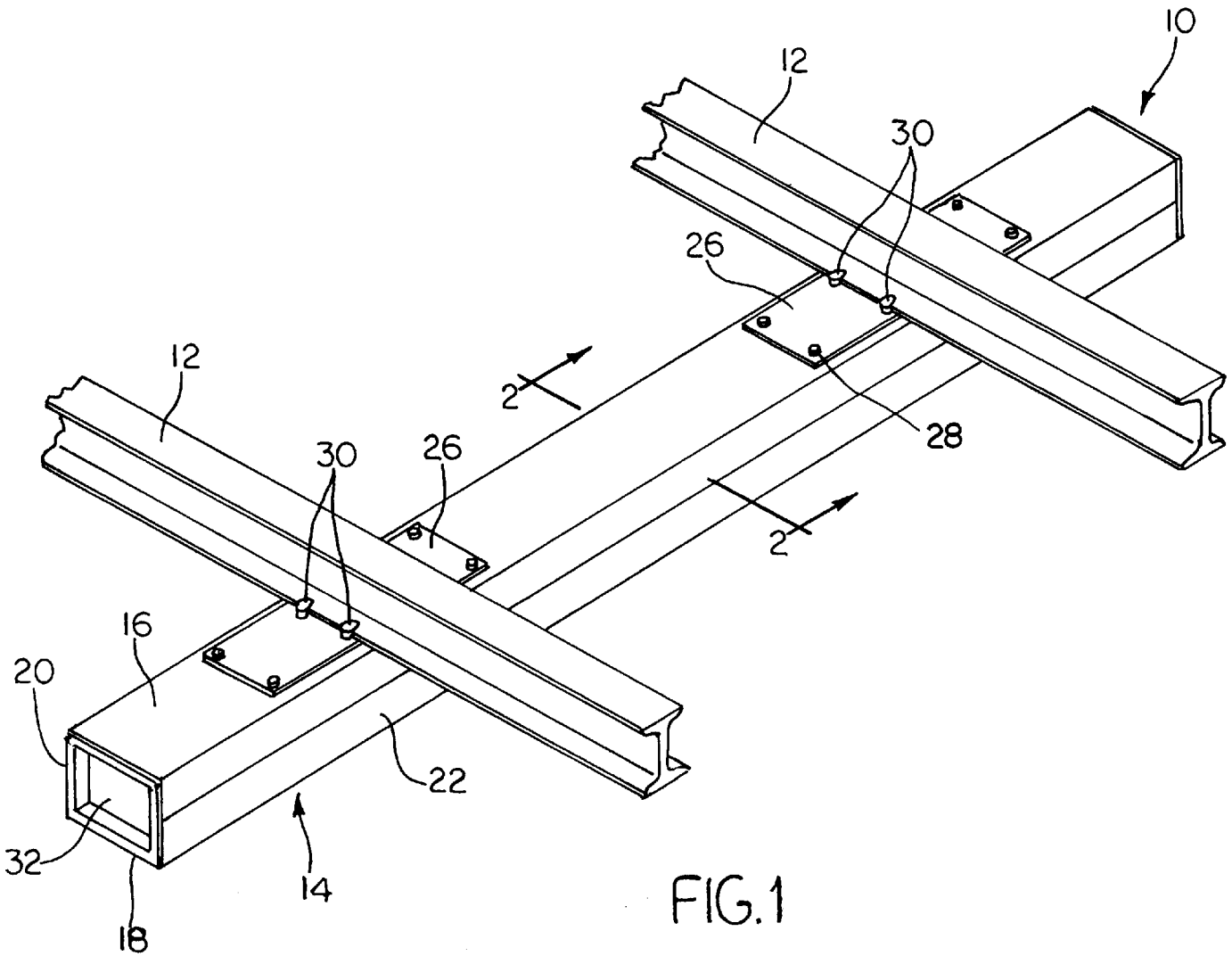
FIG. 1 is a view in perspective of a railroad crosstie made pursuant to the teachings of the present invention and the rails supported by the crosstie.
Figure 2:
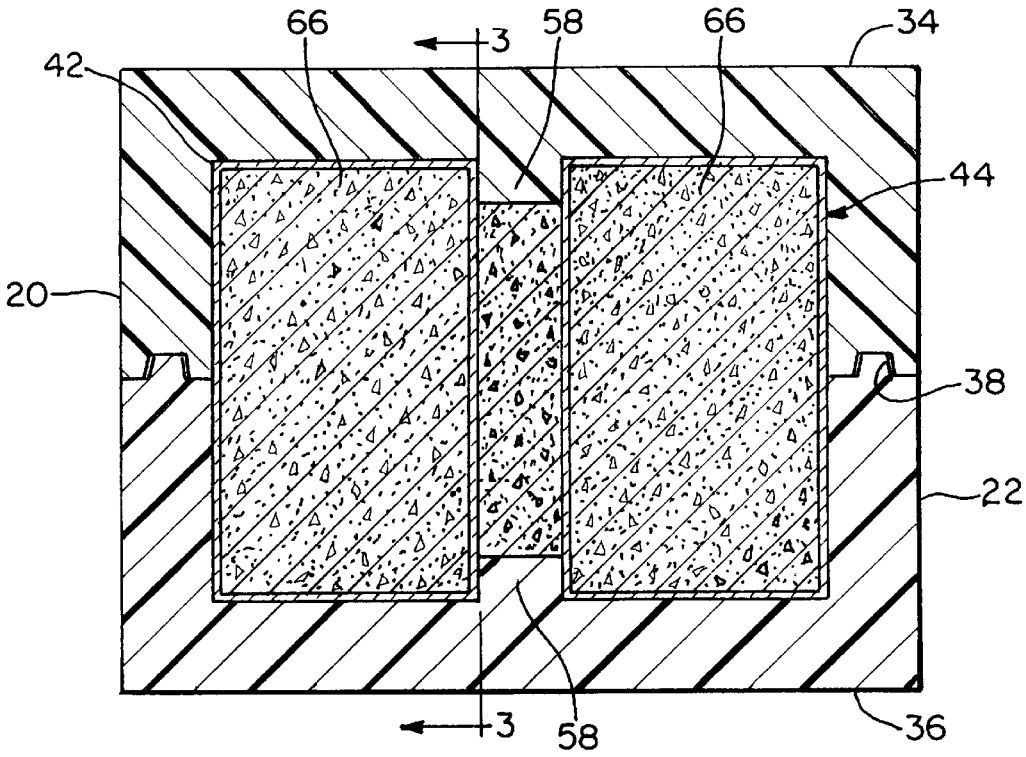
FIG. 2 is a transverse cross sectional view taken substantially along lines 2—2 FIG. 1.

Referring now to the drawings, a railroad tie made pursuant to the teachings of the present invention is generally indicated by the numeral 10 and supports substantially parallel railroad rails 12 in a manner well known to those skilled in the art. The tie 10 includes an outer casing generally indicated by the numeral 14 defining an upper surface 16, a lower surface 18, an opposite side surfaces 20, 22. Rail support areas 24 (FIG. 4) are defined upon the upper surface 16 of the tie 10, and tie plates 26 are mounted on the rail support areas 24 by fasteners 28. Conventional spikes 30 are driven through apertures 32 in the tie plates 26 and into the railroad tie 10 as will hereinafter be described to secure rails 12 to the crosstie 10. End caps 32 close the opposite ends of the tie 12.

Figure 3:
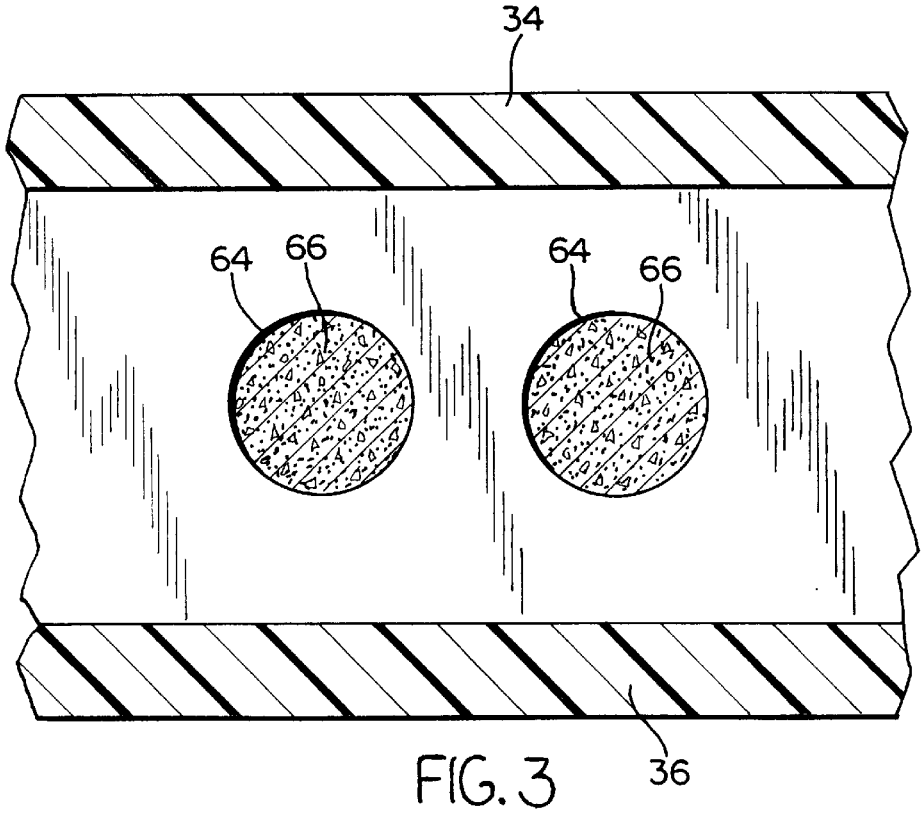
FIG. 3 is a fragmentary, longitudinal cross sectional view taken substantially along lines 3—3 of FIG. 2.
Figure 4:
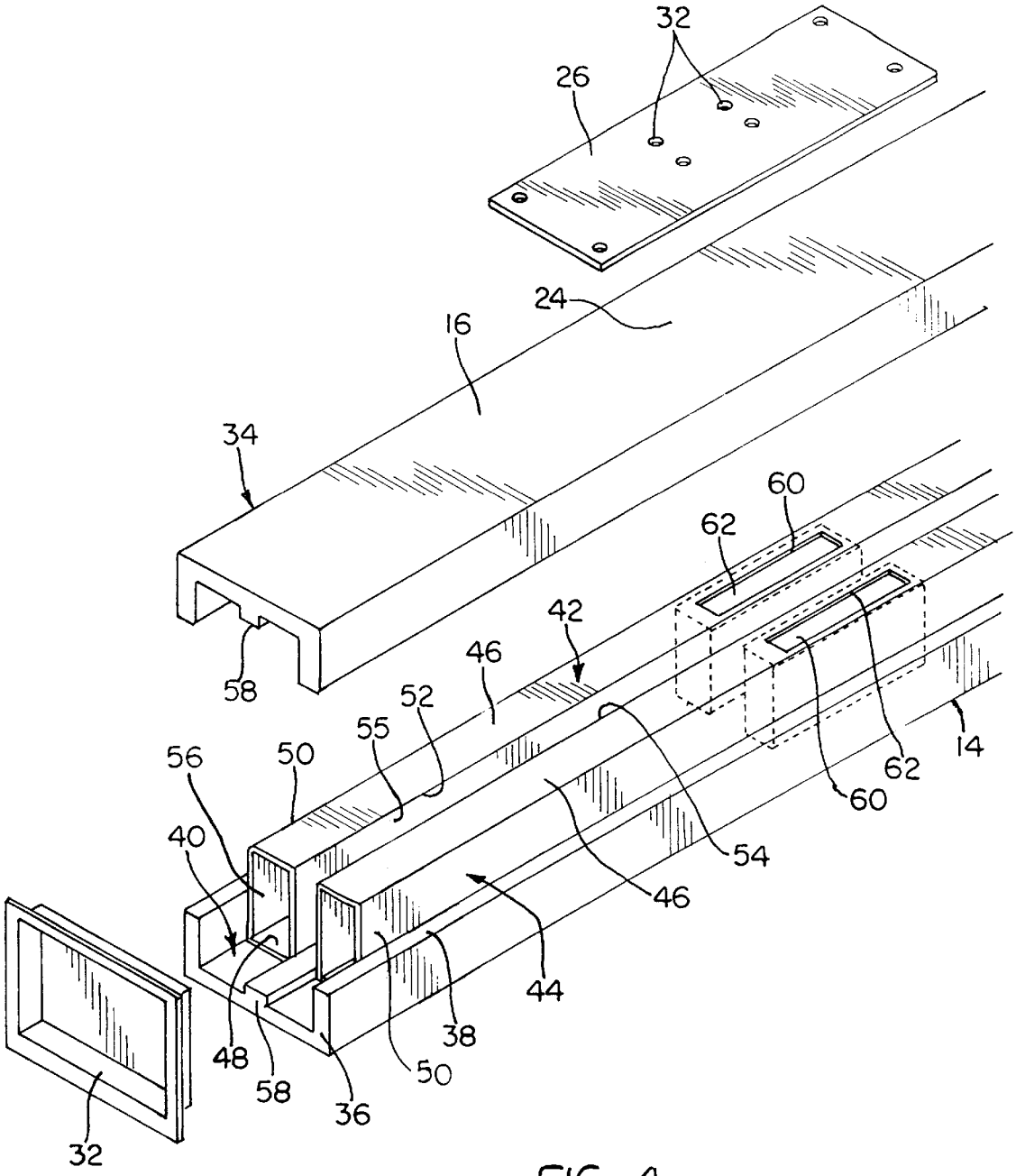
FIG. 4 is an exploded view in perspective of the cross tie illustrated in FIG. 1, and illustrating the internal components thereof before the concrete reinforcing material is installed with in the tie.

As shown in FIG. 4, the casing 14 includes an tipper section 34 and a lower section 36 which are secured together along their inner face 38 by an appropriate adhesive, preferably an aeronautical grade urethane adhesive available from Mactac Corporation. The casing sections 34, 36 are made out of a composite material as will be described hereinafter. The casing 14, when assembled, defines a cavity generally indicated by the numeral 40 (FIG. 4). A pair of elongated. tubular reinforcing beams 42, 44 are located in the cavity 40 adjacent the side walls 20 and 22, respectively, as shown in FIG. 3. With reference again to FIG. 4, each of the tubular beams 42, 44 includes an upper surface 46 which engages the upper section of the casing 34 when the tie is assembled, a lower surface 48, which rests on the lower section 36 of the casing, a side surface 50, which engages the inside of the corresponding wall 20, 22 of the casing; and an inner surface 52, which faces the corresponding inner surface 54 of the other tubular beam and cooperates therewith to define a longitudinal volume generally indicated by the numeral 55 therebetween. The surfaces 46, 48, 50, 52 of the tubular beams 42 and 44 cooperate to define a chamber 56 within each of the tubular beams 42, 44. Projections 58 project from the upper and lower sections 34, 36 of the outer casing 14 and into the cavity 40 to engage the upper and lower portions of the side walls 52 to thereby locate the beams 42 and 44 in their proper positions within the cavity 40.

Each of the beams 42, 44 have a pair of apertures (only one of which is shown for each beam at 60) which extend below the rail support areas 24 of the crosstie 10. A pair of composite inserts (only one of which for each beam is shown at 62 in FIG. 4) are installed in each of the beams 42, 44 by pushing them in from the corresponding end of the beam until the inserts 62 register with the aperture 60. The inserts 62 are made out of the same composite material as is the casing 14, which will be described in detail hereinafter. Each of the side walls 52 of the beams 42, 44 are provided with openings 64 (FIG. 3) therein in that portion of the side wall 52 extending between the apertures 60. As can be seen in FIG. 4, the ends of the beams 42, 44 terminate a short distance away from the end of the outer casing 14.

A reinforcing material generally indicated by the numeral 66 (FIG. 3) is pumped into the chambers 56 of the beams 42, 44 from both ends thereof after the upper and lower sections of the casing are secured to one another and the reinforcing material is simultaneously pumped into the volume 55 between the beams. The reinforcing material pumped into volume 54 enters that portion of the inner chambers 56 of the beams between the inserts 62 through the openings 64. Accordingly, the entire volume of the cavity 40 is filled with the reinforcing material. The reinforcing, material 66 is preferably a fast drying concrete material capable of being pumped into the crosstie 10 as a liquid. Such a material is commonly referred to as a "flowable fill" concrete. Alternatively, a fast drying polyurethane material may be substituted.

The tubular reinforcing beams 42, 44 increase the stiffness of the crosstie 10, while still providing shock absorbing and vibration dampening qualities in the crosstie providing a smooth ride for the train using the tracks supported by the crosstie. If higher axle loads than normal are to be accommodated, the thickness of the material of the tubular members 42, 44 may be increased, thereby increasing the stiffness of the beam to accommodate the higher axle loads. The beams 42, 44 also resist crumbling of the concrete injected into the chambers 56 within the beams since the beams 42, 44 are preferably made of steel and resists flexing.

The composite material used in the upper and lower sections 34, 36 of the casing and for the inserts 62, as will be described hereinafter, are a mixture of recycled plastic and crumb rubber. This material withstands weathering, but is sufficiently deformable to permit the spikes 30, which hold the rails 12 to the crosstie 10, to be driven through the openings 32 in the plate 26, through the rail supporting areas 24 on the upper section 34 of the casing 14, through the aperture 60 in the corresponding one of the tubular beams 42, 44, and into the composite material of the inserts 62. Accordingly, spikes can be driven into the crosstie 10 to hold the rails 12 in place in exactly the same manner that spikes are used to hold rails on conventional wooden crossties.

Figure 5:
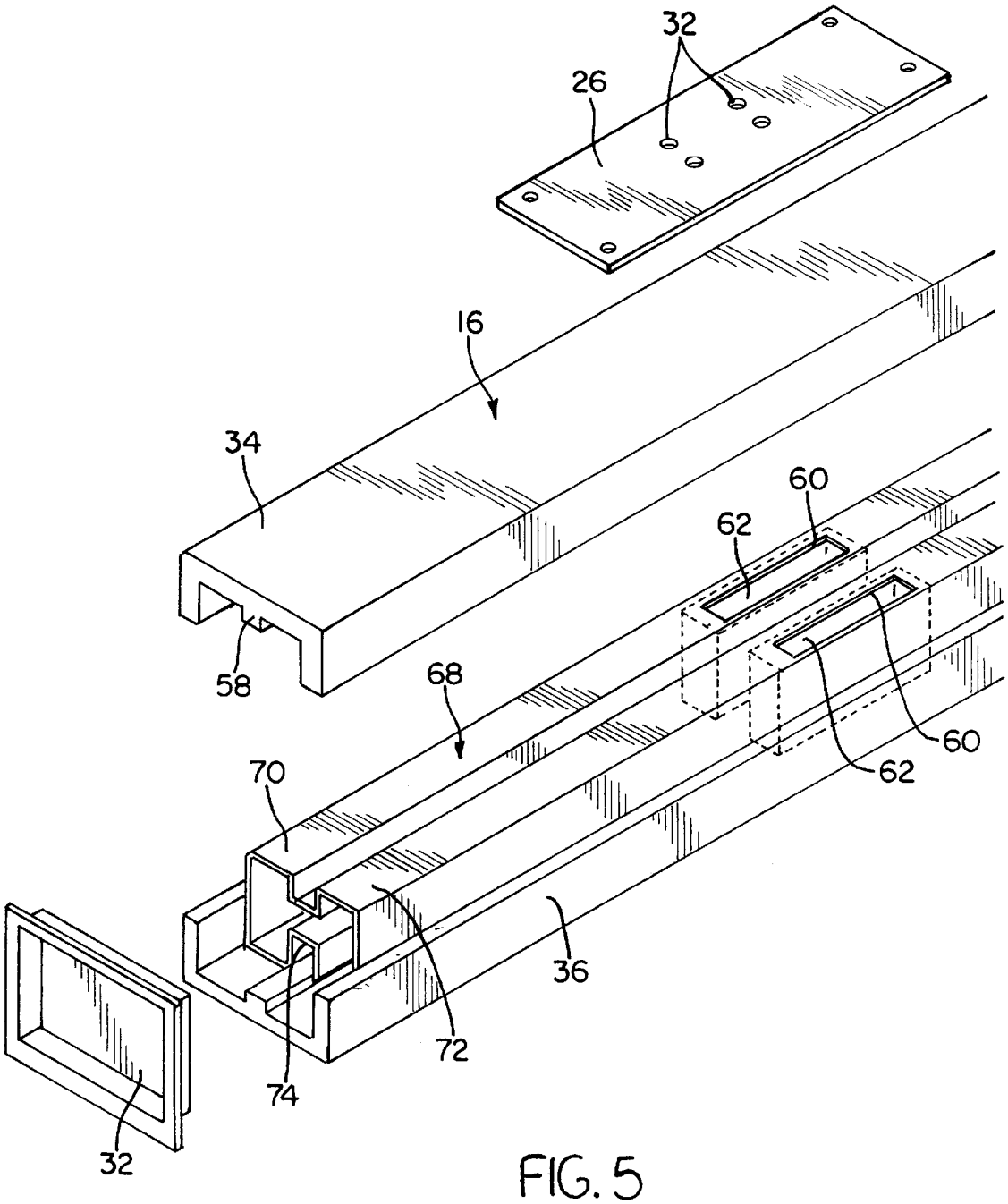
FIG. 5 is a view similar to FIG. 4, but illustrating another embodiment of the invention.
Figure 6:
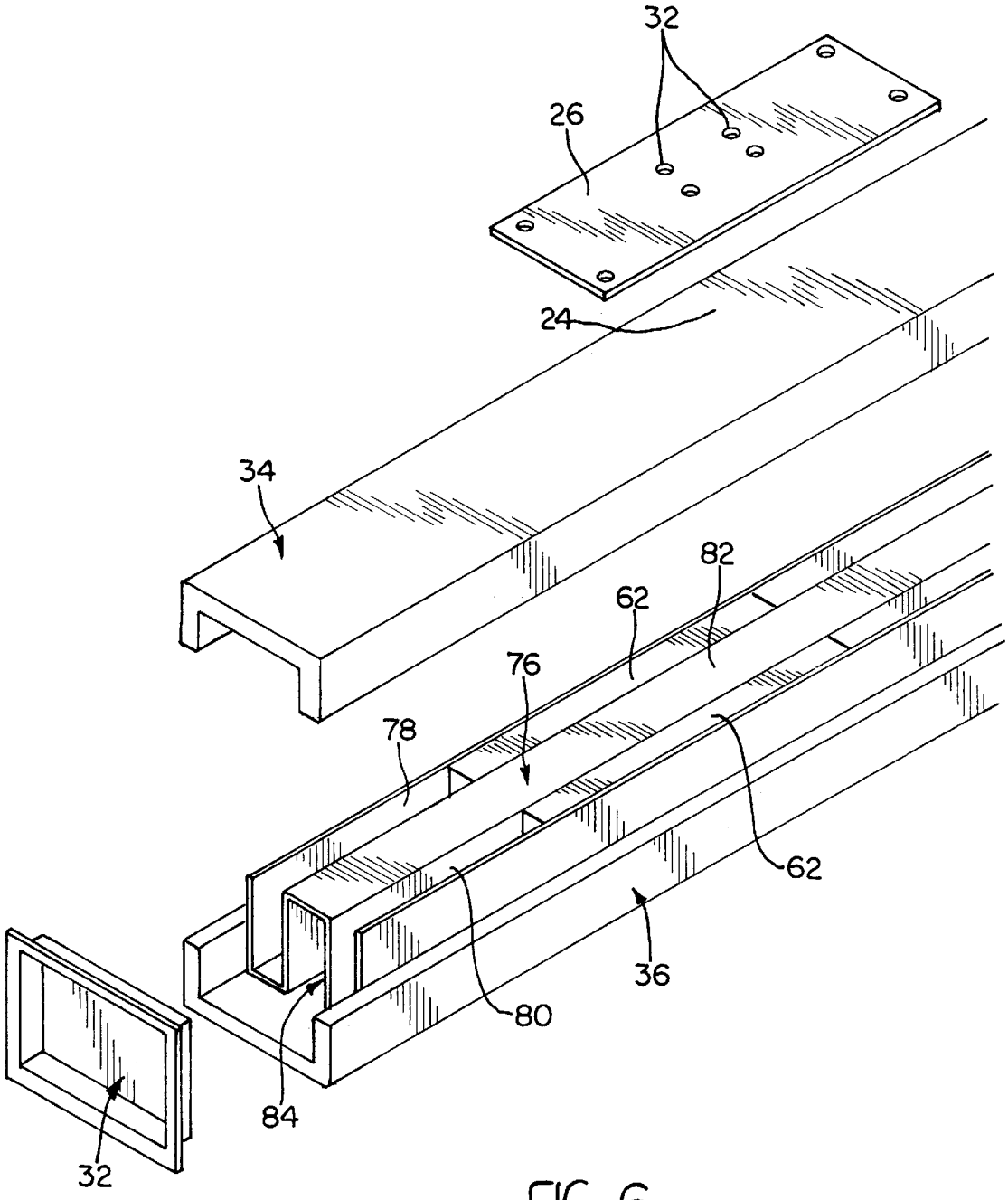
FIG. 6 is a view similar to FIGS. 4 and 5, but illustrating still another embodiment of the invention.

Referring to the alternative embodiment of FIG. 5 and 6, elements the same or substantially the same as those of the embodiment of FIGS. 1–4 retain the same reference character. In FIG. 5, the two tubular beams 42, 44 are replaced by a single tubular beam generally indicated by the numeral 68 having a "H" cross section consisting of longitudinally extending arms 70 and 72 and a connecting portion 74. Insert 62 are installed in the arms 70, 72 in the same way as they are installed in the tubular beams 42, 44; that is, they are installed through the ends of the beam 68. Concrete or an equivalent reinforcement material is pumped into the beam 70 to provide the necessary reinforcement. Referring to the embodiment of FIG. 6, the tubular beams 42, 44 is replaced by a "W" beam generally indicated by the numeral 76. W beam 76 defines a pair of upwardly facing channels 78, 80 adjacent the side surfaces of the outer casing which are separated by transverse portion 82 of the beam 76, which defines a longitudinal extending volume 84 separating the channels 78, 80. Inserts 62 are installed in the channels 78, 80 but merely placing them therein before the upper section 34 is installed on the lower section 36. Concrete is pumped into the volume 84 through the ends thereof and is installed directly into the channel 78, 80 before the assembly of the outer casing 14 is completed by installing the upper section 34 and the lower section 36 and by also thereafter installing end cap 32.

As discussed above, the outer casing 14 and the inserts 62 are a 50—50 mixture of high density polyethylene and crumb rubber. Preferably, the high density polyethylene is obtained from recycled plastics, such as found in plastic shampoo or detergent bottles, etc. that have been shredded as is known in the industry. The rubber particles are preferably "crumb" rubber articles obtained from recycled automotive tires that have been ground and sized as is known in the art. The size of the rubber particles is preferably "ten mesh" according to standard industry sizing methods. Rubber particles 14 may include approximately 1% or less by volume long strand nylon fibers, which are commonly found in ground tires. As discussed above, the rubber particles provide a semi- resilient quality to the plastic, thus preventing the plastic from cracking upon the driving of the spikes 30 into the outer casing and into the insert 62. The mixture may be varied to contain as much as 60% shredded high density polyethylene and 40% crumb rubber to 40% shredded high density polyethylene and 60% crumb rubber.

The details of the composite material are given by the following example:

EXAMPLE 1

A quantity of used polyethylene bottles from various sources is ground in a shredder, which produces non-uniform plastic particles of approximately one-half inch square, and of varying shapes and thicknesses. A quantity of used automobiles tires is ground into crumb rubber particles using any commercially available grinding method. Using a 10-mesh screen, which is a screen having 100 holes per square inch (10 rows and 10 columns of holes per square inch), the crumb rubber is sized to produce 10-mesh rubber particles. Typically, the 10-mesh crumb rubber will include approximately 1% by volume long strand nylon fibers from the reinforcing belts found in most tires. The crumb rubber particles and the shredded plastics are combined into a 50—50 mixture by volume.

The composite crosstie is extruded using a Compact Compounder having a long continuous mixer and a singe screw extruder, such as is manufactured by Pomini, Inc. of Brecksville Ohio. The shredded polyethylene is placed in the first supply hopper of the co-extruder, and the crumb rubber particles are placed in a second supply hopper. The shredded plastic and the rubber particles are introduced into the barrel and brought to a molten state under pressure by the friction of the counter-rotating rotors. The melted mix is then fed into a single screw extruder, forced forward through the barrel by a supply screw. The plastic/rubber mix is then extruded through a die to form the upper casing section 34. As the casing section or insert is extruded, it is cooled and cut into standard segments. The casing sections may be cut to longer or shorter lengths as desired depending on the length requirements of the specific application.

Again, minor departures from the 50—50 ratio can be achieved without significantly reducing the beneficial properties of the final product. This variations can be especially useful when the weight or density of the final product needs to be tightly controlled. The natural gray/black color of the plastic/rubber matric will be suitable for most applications. However, a small amount of colorant can be added in order to produce a different colored member. For example, red dye can be added in order to produce a simulated wood member, and will give the appearance of cedar or redwood depending on the amount of dye added.

Figure 7:
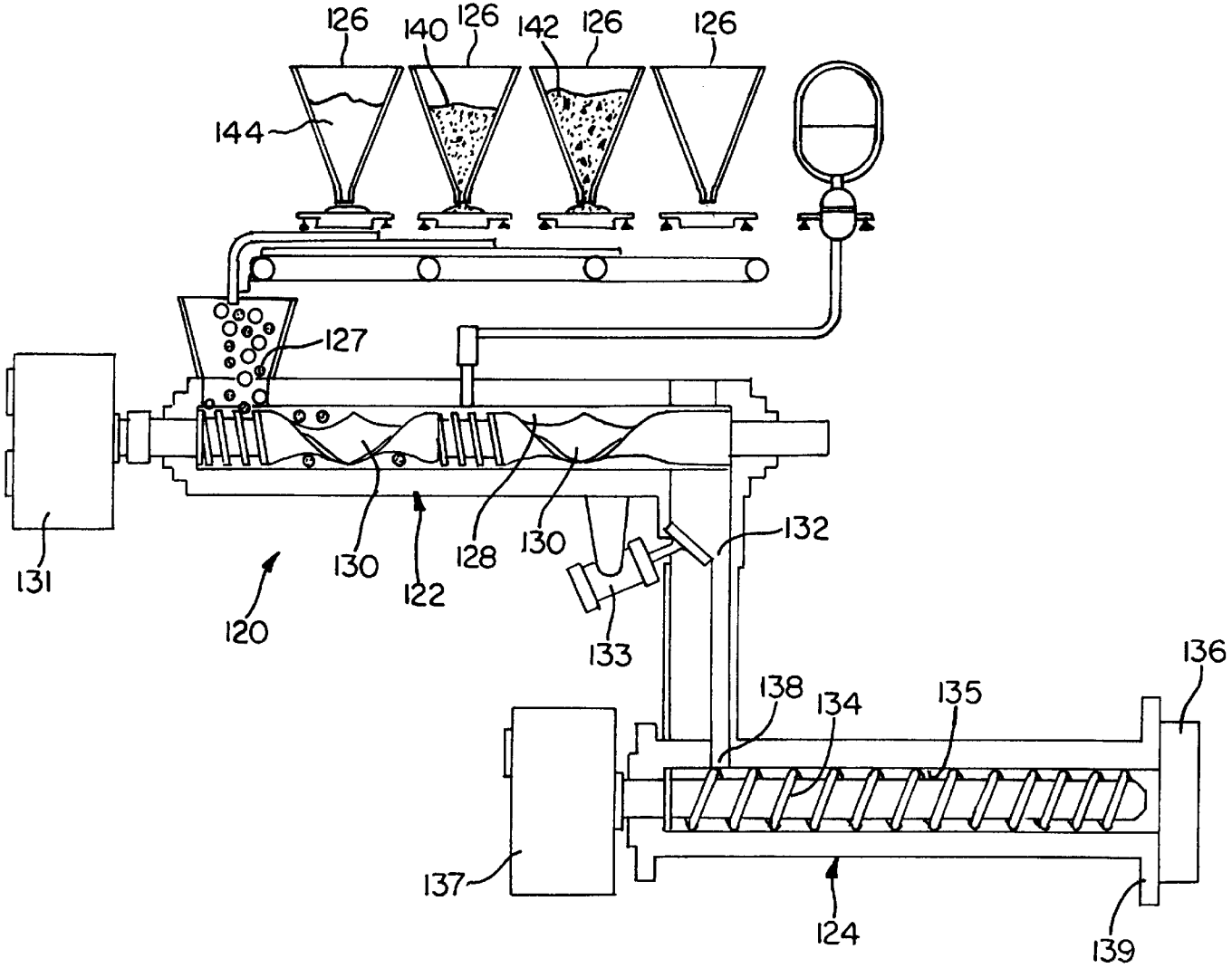
FIG. 7 is a schematic illustrated of a compact compounder used to manufacture the components of the present invention made out of composite material.

FIG. 7 illustrates a compact compounder 120 used to extrude the present invention, Compounder 120 is manufactured by Pomini, Inc. of Brecksville Ohio. Compounder 120 includes long continuous mixer 122 and single screw extruder 124. Long continuous mixer 122 includes indeed hoppers 126, inlet 127, and barrel or mixing chamber 128. Mixer 122 also includes discharge orifice 132 having discharge valve 133. A pair of counter rotating rotors 30 are disposed within chamber 128, and rotors 130 are driven by motor 131. Single screw extruder 124 includes plasticating supply screw 134 as is commonly employed in the extrusion process. Single screw extruder 124 has inlet 138 which is in flow communication with discharge orifice 132 of mixer 122. Plasticating supply screw 134 is mounted within barrel or chamber 135, and is driven by motor 137. Discharge die 136 is mounted to outlet end 139 or extruder 124. Discharge die 136 is sized to match the desired corss-sectional dimensions of the extruded member.

Shredded plastic material 140 and crumb rubber 142 are fed from indeed hoppers 126 into long continuous mixer 122 and mixed under pressure by rotors 130 driven by drive motor 131. Alternatively, a small amount of dye 144 may also be fed into the mix from indeed hopper 126. Initially, discharge valve 133 at discharge orifice 132 is closed, which maintains pressure in barrel 128. Friction created by counter rotating rotors 130 work the material into a molten state, at which point valve 133 opens and allows molten material to flow into the extruder 24 through inlet 138. Motor 137 of extruder 124 drives supply screw 134, which urges the molten material under pressure towards outlet end 139 and through die 136. The extruded member (not shown) is cut into the desired length and cooled.

What is claimed is:

1. Railroad crosstie having a pair of rail support areas spaced longitudinally along said crosstie for supporting rails comprising an outer casing defining a longitudinally extending cavity therein, said outer casing being made of a material sufficiently yieldable to permit fasteners for holding said rails on the support areas to be driven through the casing and into said cavity, a beam extending longitudinally within said cavity and extending beneath said rail support areas, said beam defining a chamber therewithin, inserts mounted in said chamber beneath said rail support areas and made of a substance sufficiently yieldable to permit said fasteners holding said rails on the support areas to be driven into said inserts, and a reinforcing material filling said chamber.

2. Railroad crosstie as claimed in claim 1, wherein said reinforcing material is concrete.

3. Railroad crosstie as claimed in claim 1, wherein said casing cooperates with said beam to define a volume within said cavity outside of said beam, said reinforcing material filling said volume.

4. Railroad crosstie as claimed in claim 1, wherein said beam is a tubular member having an inner surface defining said chamber, said tubular member including an upper surface defining apertures exposing, said insert whereby said fasteners may be driven through the casing and said apertures and into said inserts.

5. Railroad crosstie as claimed in claim 4, wherein said casing includes a pair of side walls, a top wall and a bottom wall joining said side walls, said top wall carrying said rail support areas, said tubular member including a pair of side surfaces extending parallel to said side walls of the casing, one of said side surfaces engaging a side wall of the casing, the other side wall defining in part said volume.

6. Railroad crosstie as claimed in claim 5, wherein a pair of said tubular members extend parallel to one another within said cavity, one of said side surfaces of each of the tubular members cooperating with a side surface of the other member to define said volume.

7. Railroad crosstie as claimed in claim 6, wherein said one side surface of each member defines apertures communicating said volume with the portion of the chamber of each tubular member between said inserts.

8. Railroad crosstie as claimed in claim 6, wherein said top and bottom walls of the casing include projections locating said tubular members within the cavity.

9. Railroad crosstie as claimed in claim 3, wherein said beam is a channel member having opposite ends defining a channel facing toward said rail support areas, said inserts being mounted in said channel, said reinforcing material filling said channel between said inserts and between each insert and a corresponding end of the channel.

10. Railroad crosstie as claimed in claim 4, wherein said reinforcing material is concrete and said casing is made of a composite material comprising 40%–60% by volume recycled high density polyethylene and 60%–40% by volume ground rubber particles.

11. Railroad crosstie as claimed in claim 1, wherein said casing is made of a composite material comprising 40%–60% by volume recycled high density polyethylene and 60%–40% by volume ground rubber particles.

12. Railroad crosstie as claimed in claim 1, wherein said beam is a tubular member and said inserts are mounted within said tubular member, said tubular member including apertures exposing said inserts whereby fasteners driven through the rail supporting areas of the casing extend through the apertures and into the inserts.

13. Railroad crosstie as claimed in claim 12, wherein a pair of said tubular members are mounted in said cavity, each of said tubular members carrying inserts and defining apertures exposing said inserts, said tubular members cooperating with each other to define a volume therebetween, said reinforcing material filling said volume and multiple chambers within said tubular members defined between the ends of the tubular members and the inserts and between said inserts.

14. Railroad crosstie having a pair of rail support areas spaced longitudinally along said crosstie for supporting rails comprising an outer casing defining a longitudinally extending cavity therein, said outer casing being made of a material comprising 40%–60% by volume recycled high density polyethylene and 60%–40% by volume ground rubber particles, a beam extending longitudinally within said cavity and extending beneath said rail support areas, and a reinforcing material substantially filling said cavity around said beam.

15. Railroad crosstie as claimed in claim 14, wherein said reinforcing material is concrete.

16. Railroad crosstie as claimed in claim 14, wherein inserts made of a yieldable material are mounted in said cavity below said rail support areas.

17. Railroad crosstie as claimed in claim 16, wherein said inserts are mounted in said beam.

18. Railroad crosstie as claimed in claim 17, wherein said inserts are made of the same material as said casing.

19. Railroad crosstie as claimed in claim 14, wherein said beam is a tubular member and said inserts are mounted within said tubular member, said tubular member including apertures exposing said inserts whereby fasteners driven through the rail supporting areas of the casing extend through the apertures and into the inserts.

20. Railroad crosstie as claimed in claim 19, wherein a pair of said tubular members are mounted in said cavity, each of said tubular members carrying inserts and defining apertures exposing said inserts, said tubular members cooperating with each other to define a volume therebetween, said reinforcing material filling said volume and multiple chambers within said tubular members defined between the ends of the tubular members and the inserts and between said inserts.

21. A railroad cross-tie, comprising:

an elongate strengthening member;

reinforcement material rigidifying said elongate strengthening member; and an outer casing, comprised of a deformable composite material, which substantially surrounds said elongate strengthening member and said reinforcement material.

22. The railroad cross-tie of claim 21, wherein the outer casing is comprised of a composite material of 40%–60% by volume polyethylene and 60%–40% by volume ground rubber particles.

23. The railroad cross-tie of claim 21, wherein the elongate strengthening member is comprised of a steel beam.

24. The railroad cross-tie of claim 23, wherein the elongate strengthening member is comprised of at least one elongate tubular steel beam.

25. The railroad cross-tie of claim 24, comprising two elongate tubular steel beams.

26. The railroad cross-tie of claim 24, wherein said steel beam is configured in a substantial "H" cross-section.

27. The railroad cross-tie of claim 23, wherein said steel beam is configured in a substantial "W" cross-section.

28. The railroad cross-tie of claim 21, wherein said elongate strengthening member is defined by at least two elongate and interconnected sidewalls, to define an inner volume therebetween.

29. The railroad cross-tie of claim 28, wherein said reinforcement material fills said volume.

30. The railroad cross-tie of claim 29, wherein said reinforcement material is concrete.

31. The railroad cross-tie of claim 30, wherein said outer casing is comprised of a composite material of 40%–60% by volume polyethylene and 60%–40% by volume ground rubber particles.

32. The railroad cross-tie of claim 31, wherein said elongate strengthening member is configured in a substantial "W" cross-sectional configuration.

33. The railroad cross-tie of claim 32, wherein said outer casino is comprised of two complementary halves, encompassing said concrete-filled, elongate strengthening member.

34. The railroad cross-tie of claim 33, wherein said at least sidewalls, of said strengthening member, are interconnected via an elongate wall.

35. The railroad cross-tie of claim 34, further comprising composite inserts positioned within said volume, in order to retain fasteners inserted therein.

* * * * *

UNITED STATES PATENT AND TRADEMARK OFFICE

CERTIFICATE OF CORRECTION

PATENT NO. : 6,179,215 B1

DATED : January 30, 2001

INVENTOR(S) : Marc Shea

It is certified that error appears in the above-identified patent and that said Letters Patent is hereby corrected as shown below:

Claim 33, Line 46, "casino" should be - - casing –

Signed and Sealed this

Fifteenth Day of May, 2001

*Attest:*

Nicholas P. Godici

NICHOLAS P. GODICI

*Attesting Officer*

*Acting Director of the United States Patent and Trademark Office*